United States Patent [19]

Hamblin

[11] 4,017,108

[45] Apr. 12, 1977

[54] WINDOW STAY

[75] Inventor: Richard David Hamblin, Birmingham, England

[73] Assignee: Archibald Kenrick and Sons Limited, England

[22] Filed: Apr. 17, 1975

[21] Appl. No.: 568,912

[52] U.S. Cl. ..... 292/262

[51] Int. Cl.[2] ..... E05C 17/04

[58] Field of Search ..... 292/262–278

[56] References Cited

UNITED STATES PATENTS 137,031 3/1873 Rayer ..... 292/265

FOREIGN PATENTS OR APPLICATIONS 192,799 11/1957 Austria ..... 292/265

*Primary Examiner*—Richard E. Moore

*Attorney, Agent, or Firm*—Andrus, Sceales, Starke & Sawall

[57] ABSTRACT

A window stay comprising an attachment part and an elongated stay bar, the attachment part having pivoted therein a headed pin through the end of which extends a transverse pin on which the stay bar is itself pivoted the further pin occupying a position adjacent to a spigot formed on the attachment part to prevent the pin becoming detached from the attachment part.

7 Claims, 2 Drawing Figures

WINDOW STAY

This invention relates to window stays of the kind comprising an elongated bar connectible to a window by means of an attachment part, usually known as a clevis, by a swivel joint which allows the stay bar to swing about two mutually transverse axes.

It is the object of the invention to provide a window stay of this kind with a swivel joint in a form which is of minimum size as well as being simple to manufacture and assemble.

According to the present invention a window stay comprises an attachment part, having a headed member rotatably mounted therein, the attachment part having a spigot surrounding the headed member and a pin pivotally connecting one end of an elongated stay bar to the end of the member remote from its head, the pin engaging in the member adjacent to the spigot thus being positioned to prevent removal of the member from the attachment part.

Figure 1:
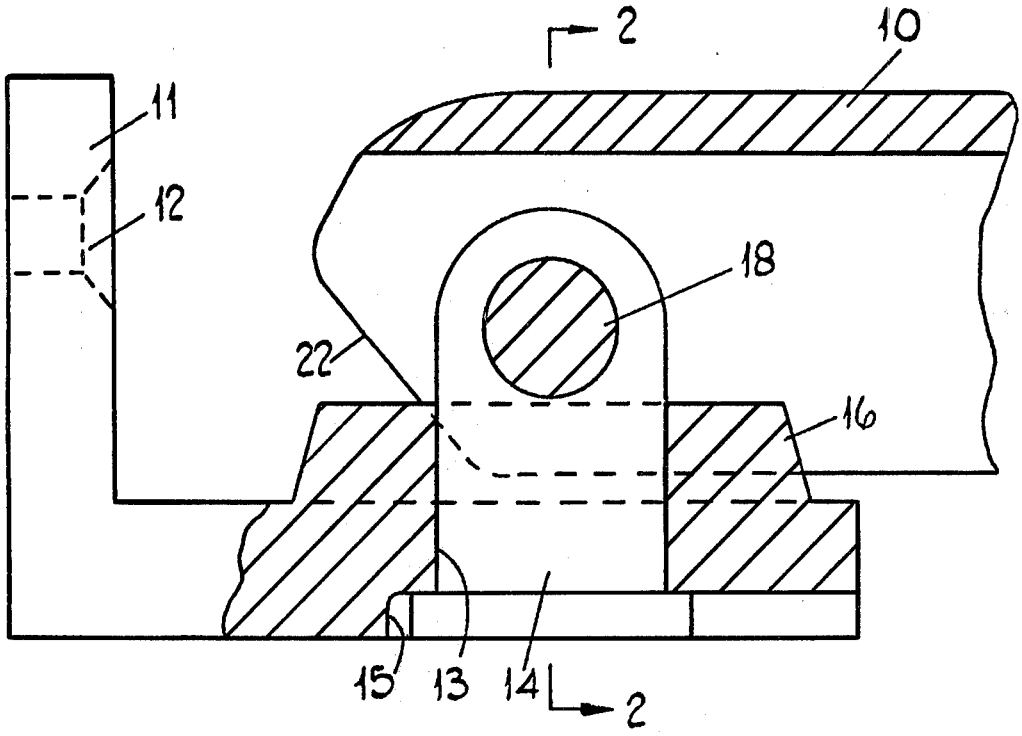
Figure 2:
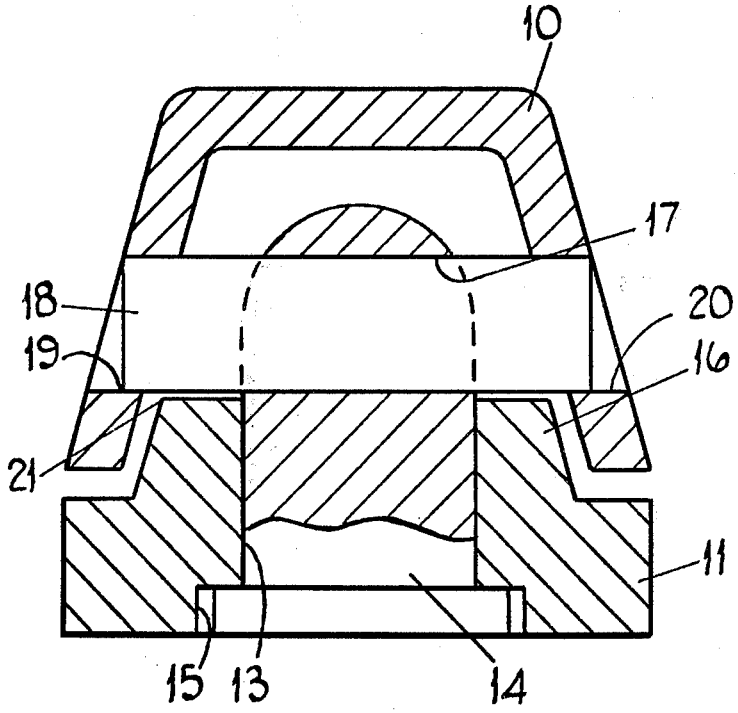

The invention will now be described by way of example with reference to the accompanying drawings, in which:

FIG. 1 is a fragmentary side elevation view, partly in cross section of a window stay constructed in accordance with the invention, and FIG. 2 is a cross section on the line 2—2 in FIG. 1.

The window stay illustrated comprises an elongated bar 10, which is of channel cross section. At intervals along its length it has holes or sockets (not illustrated) for engagement with a post (not illustrated) whereby a window to which the window stay is attached, can be held in any one of a number of alternative positions representing different degrees of opening.

The stay bar 10, is attachable to a window by means of an attachment part of clevis 11. This is of L-shape, having one limb provided with holes 12, for reception of fixing screws. The other limb has a hole 13 for reception of a generally cylindrical headed swivel member 14. This limb has in one side, a recess 15 to accommodate the head of the member 14 and on the other side there extends a shallow circular integral spigot 16 with tapered side. The spigot is concentric with the hole 13. The spigot outer side walls moreover are inclined at an angle equal to or substantially equal to the angle subtended between the sides of the channel of the other elongated stay bar 10. The other end of the headed member 14 extends beyond the flat end surface of the spigot 16 but adjacent this flat top wall or surface, the member has a diametral transverse drilling or opening 17. The extremity of the member 14 remote from its head is domed.

Passing through the drilling 17 is a transverse pin 18, which also engages is respective aligned holes 19, 20 in the side walls of the stay bar channel 10. The pin 18 is retained in such side walls by an interferance fit in the aligned holes respectively. Alternatively, it is retained by peening the ends after assembly.

Though the drawing shows a clearance 21, between the pin 18 and the flat face of the spigot 16, this is minimal and is only provided to ensure that assembly can take place, having regard to manufacturing tolerances on the component parts.

In normal use however, the pin rests on the flat end surface of the spigot 16 which thus prevents the stay bar 10 from detachment from the clevis 11. There is however a clearance between the channel interior surfaces and the side of the spigot 16. The arrangement allows the stay bar to swivel relatively to the clevis both about the axis of the member 14 and about the axis of the transverse pin 18.

The end of the stay bar 10 in which the pin 18 is engaged has its side walls shaped at 22, to provide for swivelling about the axis of the pin 18 until however a predetermined angle is reached. The stop is determined by projections formed by such shaping 22, engaging with the clevis at positions adjacent the circular spigot 16. As shown in FIG. 2, the width of the limb of the clevis having the spigot 16 upon it, has a width approximately equal to the width of the stay bar 10 and the diameter of the spigot 16, being not substantially smaller than the space between the edges of the two walls of the stay bar 10, locates the stay bar against sliding movement in the direction of the axis of the pin 18.

I claim:

1. A window stay comprising:

a. an attachment part for securement to a window, b. a circular spigot extending from one side of said part, said spigot having outer side walls and a top wall, c. said part and spigot having an opening extending therethrough, said opening being concentric with said spigot and forming a recess in said part, d. a swivel member extending through said opening, said swivel member having a head end disposed within said recess and with the other end portion of said swivel member extending beyond said top wall, e. a transverse pin extending through an opening in said other end portion of said swivel member, said pin normally engaging said top wall of said spigot, f. and an elongated stay bar pivotally connected to said pin, g. the construction being such that said stay bar is pivotable about the axes of said swivel member and said pin.

2. The window stay of claim 1 which includes stop means for limiting pivotal movement of said stay bar about the axis of said swivel member.

3. The window stay of claim 2 in which said stay bar is provided with side walls shaped to engage the said outer side walls of said spigot to form the said stop means.

4. The window stay of claim 1 wherein said stay bar is channel shaped and is provided with side walls, and wherein the said outer side walls of said spigot and the said stay bar side walls are approximately equally inclined.

5. The window stay of claim 4 wherein the width of said stay bar and of said attachment part adjacent said spigot are approximately equal.

6. The window stay of claim 3 wherein said stay bar is channel shaped and is provided with side walls, and wherein the said outer side walls of said spigot and the said stay bar side walls are approximately equally inclined.

7. The window stay of claim 6 wherein the width of said stay bar and of said attachment part adjacent said spigot are approximately equal.

* * * * *

UNITED STATES PATENT AND TRADEMARK OFFICE

CERTIFICATE OF CORRECTION

PATENT NO. : 4,017,108

DATED : April 12, 1977

INVENTOR(S) : Richard David Hamblin

It is certified that error appears in the above-identified patent and that said Letters Patent are hereby corrected as shown below:

| | |
|---|---|
| Column 1, Line 37 | Delete "of" second occurrence and substitute therefor ---or--- |
| Column 1, Line 47 | After "the" third occurrence, delete "other" |
| Column 1, Line 49 | After "flat" insert ---top wall or--- |
| Column 1, Line 50 | After "flat" delete "top wall or" |
| Column 1, Line 55 | After "engages" delete "is" and substitute therefor ---in--- |

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*